US006069962A

United States Patent [19]

Miller

[11] Patent Number: 6,069,962

[45] Date of Patent: May 30, 2000

[54] POINT SOURCE SPEAKER SYSTEM

[76] Inventor: Francis Allen Miller, 1918A Broadway, Alameda, Calif. 94501

[21] Appl. No.: 09/227,006

[22] Filed: Jan. 7, 1999

Related U.S. Application Data

[63] Continuation-in-part of application No. 09/173,606, Oct. 14, 1998.

[51] Int. Cl.[7] ..... H04R 5/02

[52] U.S. Cl. ..... 381/300; 381/303; 381/308; 381/160; 181/148; 181/155

[58] Field of Search ..... 381/300, 303, 381/304, 305, 308, 27, 28, FOR 125, FOR 165, 89, FOR 149, 152, 337, 338, 339, 345–349; 181/199, 148, 155, 185

[56] References Cited

U.S. PATENT DOCUMENTS

| | | | |
|---|---|---|---|
| 2,993,557 | 7/1961 | Miller et al. | 181/147 |
| 3,964,571 | 6/1976 | Snell | 181/152 |
| 4,256,922 | 3/1981 | Görike | 381/308 |
| 4,819,269 | 4/1989 | Klayman | 381/300 |
| 4,923,031 | 5/1990 | Carlson | 181/144 |
| 5,818,950 | 10/1998 | Satamoto et al. | 381/420 |
| 5,887,068 | 3/1999 | Givogue et al. | 381/89 |

FOREIGN PATENT DOCUMENTS

| | | | |
|---|---|---|---|
| 63-318900 | 12/1988 | Japan | 381/FOR 149 |

*Primary Examiner*—Xu Mei
*Attorney, Agent, or Firm*—Shapiro Buchman Provine Patton LLP; Mitchell S. Rosenfeld

[57] ABSTRACT

The system of the present invention includes, briefly, a point source speaker system, comprising a processor which produces a left minus right (L–R) audio signal, a right plus left (R+L) and a right minus left (R–L) audio signal; left, center and right speakers for audibly transmitting one of the L–R, R+L and R–L audio signals, respectively; left and right acoustically reflective surfaces proximate to the left and right speakers, respectively; and a point source speaker enclosure for housing the three speakers in a single enclosure.

4 Claims, 7 Drawing Sheets

POINT SOURCE SPEAKER SYSTEM

This is a continuation-in-part of application Ser. No. 09/173,606 filed on Oct. 14, 1998.

TECHNICAL FIELD

This invention relates generally to a point source speaker system and more particularly the application of the principles of wave interferometry to the reproduction of stereophonic sound via a point source speaker enclosure.

BACKGROUND ART

Traditionally, audiophiles have focused on the use of two or more speaker systems. Usually, arranged with one speaker to the left of center, another to the right, and a non-directional subwoofer for low band sounds. With the increasing popularity of home entertainment systems and surround sound, additional speakers are added to the system in an attempt to surround the listener with sound for a more life-like experience.

These traditional systems suffer from a number of defects. Most obviously, these systems are cumbersome and require a large amount of space. Some systems utilize six or more speakers, which must be placed in a particular arrangement within the listener's room. Additionally, speakers must be placed in appropriate locations in order to avoid undesirable effects on the sound quality. For example, placing speakers too close to a corner in a room produces reflections which undesirably alter to sound propagation pattern of the speaker.

The best arrangement of speakers in a room is to position the listener and the speakers in an arrangement that forms an isosceles right triangle with the angle at the vertex of the listener being 90° and the speakers being at the vertices along the base of the triangle. In practice, the distance between the speakers and the listener may vary as long as the angle at the vertex of the listener is maintained at 90°.

Even in this ideal set-up, significant problems arise that negatively impact the listener's experience. Each speaker emits a separate acoustic wave. According to the principles of wave theory, the separate waves will interact within the space-time domain to form a resultant wave form that is dependent on the phase of the original waves at particular points in the space-time domain. The interaction will be constructive in the areas of phase alignment creating an increased signal or bright spot. At points where the phase between the two original waves is 180° out of phase the interaction is destructive creating null or dead spots.

This wave interference phenomenon is akin to the effects created by a light interferometer which demonstrates the wave properties of light. A light beam is split by transmitting the light from a single source through two or more slits. The light output from the slits forms a series of bright rings where the light from each slit is in phase and dark rings where the light from each slit is out of phase.

As a result of this phenomenon as applied to acoustic waves from traditional stereo speakers, the position of the listener in the acoustic wave interference pattern determines the quality of the sound heard by the listener. Thus, if the listener is positioned at a point where the acoustic waves from the speakers are out of phase, the listener will perceive the area as a dead spot.

Additionally, the phenomenon results in what has been coined by some in the audio industry as a "comb filter effect". This term is borrowed from the field of electronics to describe a particular type of filter in which the filter throughput diagram is shaped like a comb. If a listener moves their head back and forth while listening to conventional speakers, their ears will pass through alternately pass through bright spots and dead spots (i.e., areas where the acoustic waves are in phase and out of phase, respectively. As a result the sound heard by the listener fades in and out as the listener's head moves.

Additionally, the standard two or three speaker (the third being a subwoofer) speaker arrangement also suffers the additional defect of having a weak center channel. This is partially remedied in surround sound speaker set-ups by adding a center speaker, but this utilizes additional space in the room and increases the cost of the system.

SUMMARY OF THE INVENTION

The present invention eliminates these defects through the use of a point source speaker enclosure and interferometric processing of the L and R stereo signals.

In accordance with the illustrated preferred embodiment, the present invention provides a novel, cost effective point source speaker system.

It is an object of the invention to provide a point source speaker system for reproducing stereophonic sound.

Another object of the invention is to provide a point source speaker system which utilizes the principles of wave interferometry.

An additional object of the invention is to provide a speaker system which is compact without sacrificing sound quality.

It is also an object of the invention to eliminate the problem of dead spots which is inherent in all multiple speaker systems.

An object of the present invention is to provide a point source speaker having a high degree of spatial separation between the left and right stereo channels and a strong center channel.

Another object of the present invention is to eliminate the comb filter effect which is inherent in conventional speaker systems.

Additionally, it is an object of the present invention to provide a high quality speaker system that makes efficient use of space.

The system of the present invention includes, briefly, a point source speaker system, comprising a processor which produces a left minus right (L−R) audio signal, a right plus left (R+L) and a right minus left (R−L) audio signal; three speakers each for audibly transmitting one of the L−R, R+L and R−L audio signals; and a point source speaker enclosure for housing the three speakers in a single enclosure.

The present invention has other objects and advantages which are set forth in the description of the Best Mode of Carrying Out the Invention. The features and advantages described in the specification, however, are not all inclusive, and particularly, many additional features and advantages will be apparent to one of ordinary skill in the art in view of the drawings, specification, and claims herein.

BEST MODE OF CARRYING OUT THE INVENTION

The present invention makes use of the principles of wave interferometry to provide stereophonic sound from a point source speaker enclosure. As defined herein, wave interferometry is the principle of the effect that multiple waves, such as light or in this case acoustic waves, interfere with each other in a manner that may be complementary or destructive.

The preferred embodiment makes use of wave interferometry principles by utilizing a point source speaker with three speakers, namely a left, right and center speaker. Stereophonic signals comprise two channels, left (L) and right (R). Throughout this specification and drawings the abbreviations L and R will be used to refer to the left and right stereo signals, respectively. In the preferred embodiment, the left speaker receives as an input signal L−R (that is the left stereo signal minus the right signal); the right speaker receives as an input signal R−L (that is the right stereo signal minus the left stereo signal). and the center speaker receives as an input signal R+L (that is the right signal plus the left signal). The interferometric properties of the acoustic waves produced by the pont source is discussed below in detail with respect to FIG. 6. Next the overall structure of the preferred embodiment is discussed.

Figure 5:
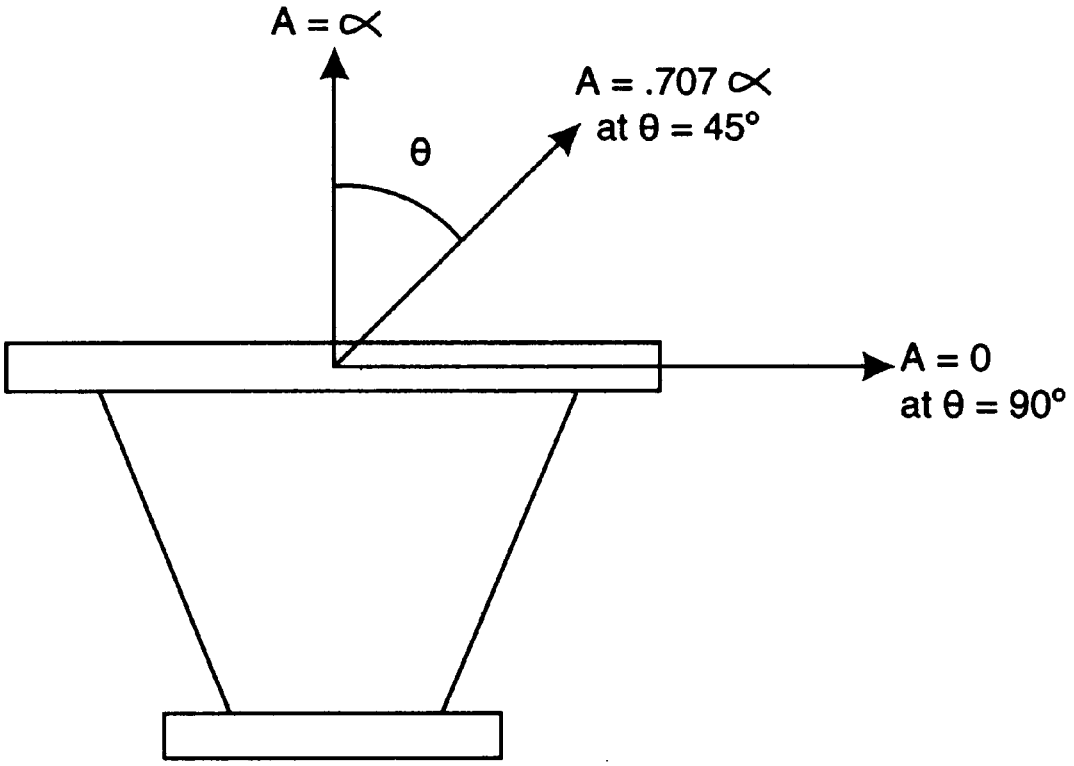
FIG. 5 is an illustrative diagram demonstrating wave propagation properties of a single speaker.

In order to understand how the present invention achieves the desired interferometric effects, examination of the propagation of an acoustic wave from a single speaker is helpful. FIG. 5 illustrates the change in amplitude of the acoustic wave depending on the angle $\theta$ from the propagation axis of the speaker. As angle $\theta$ changes, the amplitude decreases by the cosine of $\theta$, where a $\alpha$=the amplitude of a monotone signal of constant amplitude. Thus, where $\theta=45°$, $A=\alpha\cos 45°=0.707\alpha$; and where $\theta=90°$ (i.e., directly to the side of the speaker), $A=\alpha\cos 90°=0$.

Figure 6:
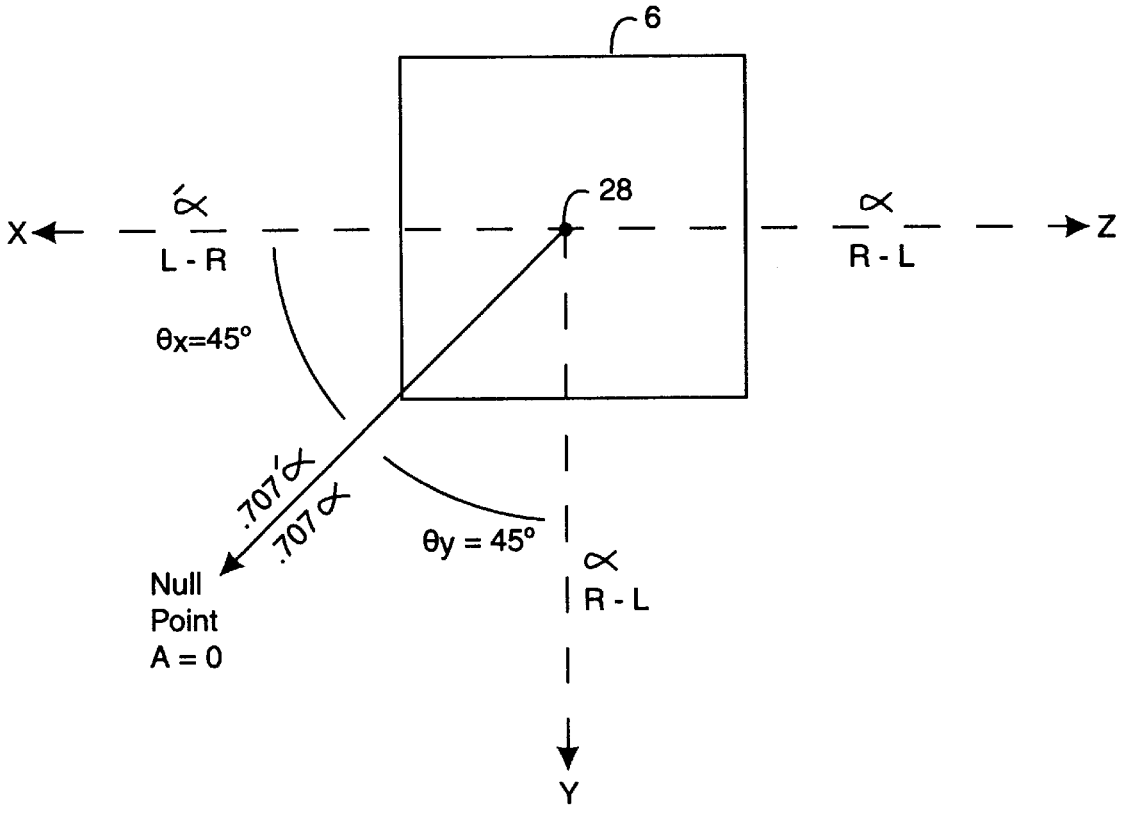
FIG. 6 is an illustrative diagram demonstrating wave propagation properties of the point source speaker enclosure of the present invention.

The wave interferometry principles of the present invention are illustrated in FIG. 6 with respect to a right channel monotone test signal of constant amplitude $\alpha$. The test signal is such that signal $R=\alpha$ and signal $L=0$. Thus, the left/right channel separation of the test signal is infinite. As a result, the following acoustic signals are produced by speakers 25, 26 and 27 (note that $\alpha=-\alpha$):

$$X \text{ axis: } L-R=0-\alpha=\acute{\alpha}$$

$$Y \text{ axis: } R+L=\alpha+0=\alpha$$

$$Z \text{ axis: } R-L=\alpha-0=\alpha$$

Stereophonic sound is premised upon the degree of separation between the right and left channels as produced by the speakers. The greater the separation, the better the stereophonic qualities. The present invention achieves an extremely high degree of separation (20–35 db depending on the configuration of point source speaker 6) by achieving null points at points 45° from the propagation axis of center speaker 26.

This is demonstrated by the test signal. The null points are created at the midline between the X and Y acoustic wave axes (45° from each axis), since the test signal is a right monotone signal. At this midline, the amplitude of the acoustic signal from the X axis is $0.707\alpha$ and the Y axis is $0.707\alpha$. This creates a null point, since the X axis acoustic signal and the Y axis acoustic signal destructively interfere. This relationship is mathematically explained below.

$$\begin{aligned} A(\text{midline}) &= (L-R)\cos 45° + (R+L)\cos 45° \\ &= .707(L-R) + .707(R+L) \\ &= .707\acute{\alpha} + .707\alpha \\ &= 0 \end{aligned}$$

Figure 1:
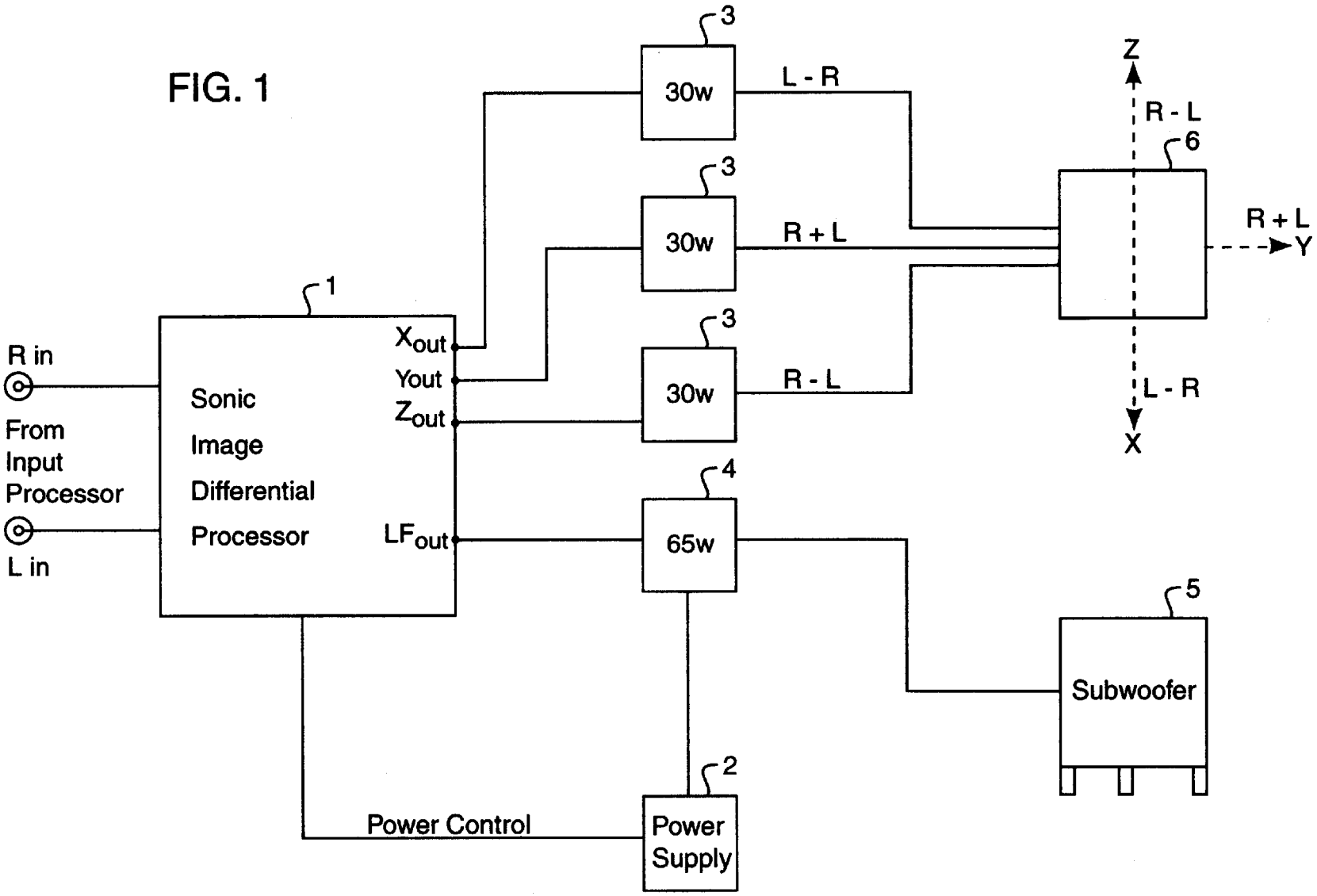
FIG. 1 is a block diagram of the preferred embodiment.

The major components of the preferred embodiment is shown in FIG. 1. These components include sonic image differential processor 1, power supply 2, three 30 watt amplifiers 3, one 65 watt subwoofer amplifier 4, subwoofer 5, and point source speaker enclosure 6. Some image processor 1 receives left and right stereo input signals (L and R) from input process 7. The structure and function of input processor 7 is discussed below with respect to FIG. 2.

As depicted in FIG. 1, sonic image differential processor 1 has two inputs for the L and R signals from input processor 6, and four outputs to amplifiers 3 and 4. The output signal from each of amplifiers 3 is input to one of the three speakers in point source speaker enclosure 6. Point source speaker enclosure 6 contains three speakers positioned such that the acoustic waves produced from the speakers propagate in a tri-axial (X,Y,Z axes) arrangement to form a tri-axial interferometric transducer array. The output signal from subwoofer amplifier 4 is input to subwoofer 5. Power is provided by power supply 2.

In operation, sonic image differential processor 1 processes the L and R signals within the interferometric frequency range in accordance with the interferometric properties of the preferred embodiment. In particular, L and R signals are processed into three channels, one for each of the three axes (X, Y, Z) of point source speaker enclosure 6, and output to amplifiers 3 via outputs Xout, Yout and Zout as L−R, R+L and R−L, respectively. The L−R, R+L and R−L signals are then amplified by amplifiers 3 and input to the X, Y and Z (left, center and right) speakers, respectively, in point source speaker 6. L and R signals below the interferometric range are output from Sonic image differential processor 1 via line feed (LF out), then amplified by subwoofer amplifier 4 and input to subwoofer 5.

Figure 2:
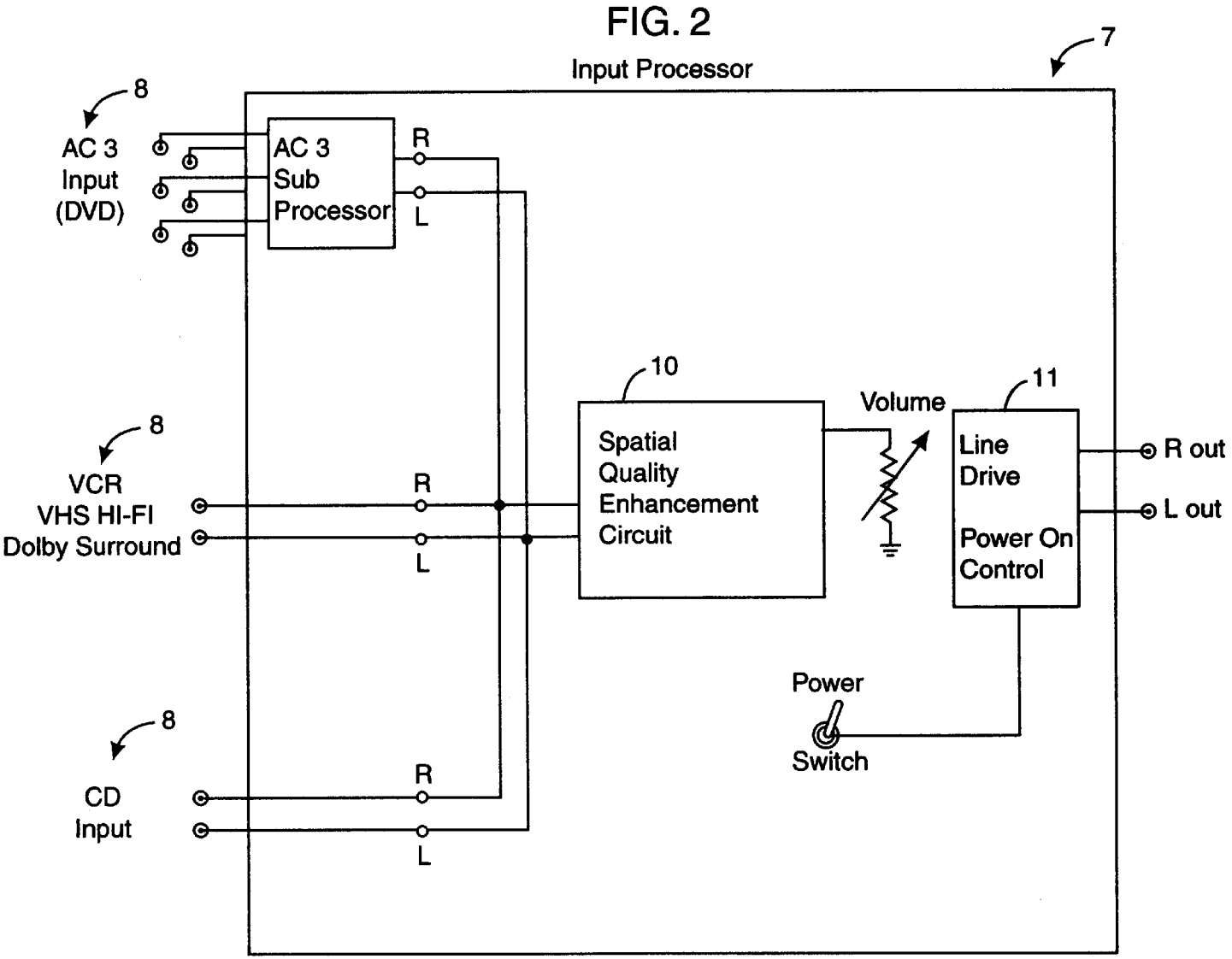
FIG. 2 is a block diagram of the input signal processor used with the preferred embodiment.

The function of input processor 7 is to simply re-process the signals from a given acoustic source 8 (such as a DVD, VCR or CD) for input to sonic image differential processor 1 and the structure may take many forms. In the preferred embodiment as shown in FIG. 2, input processor 7 includes AC 3 subprocessor 9 for an AC3 input (DVD), spatial quality enhancement circuit 10, line drive/power-on control circuit 11. Spatial quality enhancement circuit 10 may be any type of signal enhancement such as Dolby 4-2-4.

Figure 3:
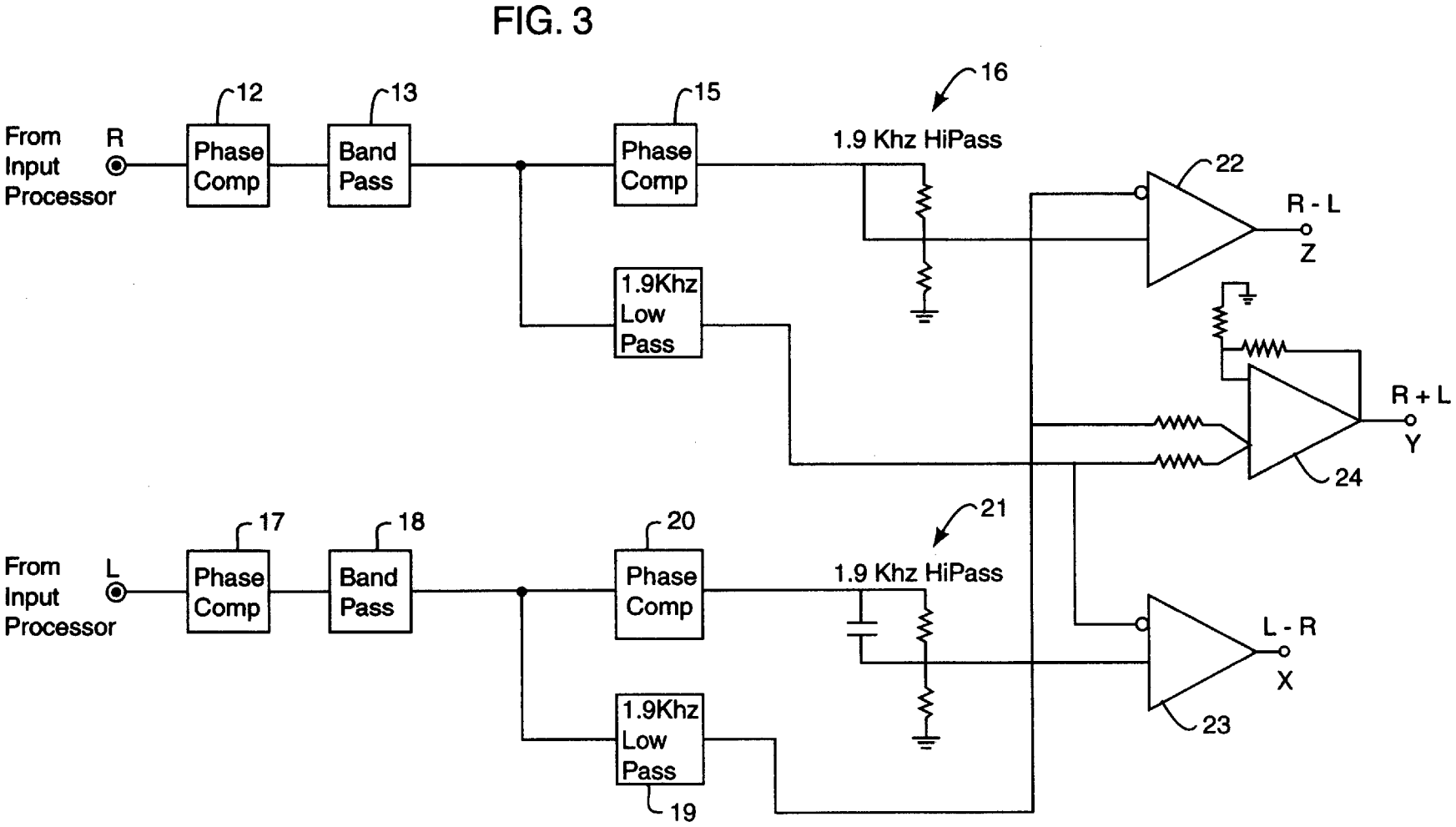
FIG. 3 is a schematic diagram of the sonic image differential processor in the preferred embodiment.

Sonic image differential processor 1 is depicted in detail in FIG. 3. As shown, the L and R signals are input to sonic image differential processor 1 from input processor 7 and processed in parallel by identical circuitry. Accordingly, the circuitry is discussed in detail only with respect to one of the channels.

Signal R is first processed by Fourier phase compensation circuit 12. Next the signal is filtered by third order band pass filter 13 with a low cut-off at 136 Hz and a high cut-off at 35 KHZ. The frequencies in the L and R signals below 136 Hz are produced by subwoofer 5 only. The output from band pass filter 13 is then passed to third order low pass filter 14 with a cut-off of 1.9 KHz, which defines the high end of the frequency band which is interferometricly processed (i.e., processed into the L−R, R+L and R−L signals). This band is referred to herein as the interferometric frequency band. The low end cut-off of band pass filter defines the low end of the interferometric frequency band or interferometric domain.

The high end interferometric domain cut-off should always be less than approximately 2 KHz. At frequencies above 2 KHz the wavelength of the acoustic waves becomes too short to create the null points necessary to obtain the desired interferometric effect. Additionally, the human ear does not respond interferometricly to such high frequencies. The low end cut-off is approximately 136 Hz as the human ear cannot perceive the direction of the acoustic wave below such a low frequency.

When the acoustic wave propagation shape changes from a figure eight shape to a cone shape at the higher frequencies, the speaker becomes more directional, i.e., forward focused only.

Once the acoustic wave turns cone shaped, the acoustic waves from the speakers in the point source enclosure 6 will not interact in manner to produce the required null points. Thus, the high-end cut-off is reached. The low-end cut-off is reached when the speaker produces as much sound backward as forward, i.e., the amplitude of the forward wave is equal to the amplitude of the backward wave.

Note, that the actual interferometric frequency band cut-off is dependent on the size and proximity of the speakers in point source speaker enclosure 6. The values for the interferometric frequency band utilized in the preferred embodiment are chosen in accordance with the particular speaker size and distance of the speaker in point source speaker enclosure as depicted in FIG. 1.

The output from band pass filter 13 is also processed by a phase delay compensator 15 to compensate for the delay in low pass filter 14. The output from phase delay compensator is then processed by shelving filter 16 (i.e., high pass filter) which increases the gain on the signal above 1.9 KHz. The frequency shelf of shelving filter 16 is chosen to match the frequency of low pass filter 14. Thus, shelving filter 16 serves to increase the gain on signal R above the interferometric frequency band. This boost of the signal above 1.9 KHz since the R and L signals above the interferometric frequency band are not produced by the center speaker in point source speaker enclosure 6. Thus, only frequencies within the interferometric domain are produced by all three speakers in point source speaker enclosure 6.

The output from shelving filter 16 (R signal) and the inverted output from low pass filter 19 (−L signal) are input to operational amplifier (op amp) 22. This results in signal R−L from op amp 22. Likewise, the output from shelving filter 21 (L signal) and the inverted output from low pass filter 14 (−R signal) are input to op amp 22. This results in signal L−R from op amp 23. Additionally, the output from low pass filter 14 (R signal) and the output from low pass filter 19 (L signal) are input to op amp 24. This results in signal R+L for the interferometric frequency band only.

In the preferred embodiment, sonic image differential processor 1 is comprised of analog circuitry. However, one of ordinary skill could readily implement the identical functionality using digital circuitry such as a DSP (digital signal processor).

Figure 4:
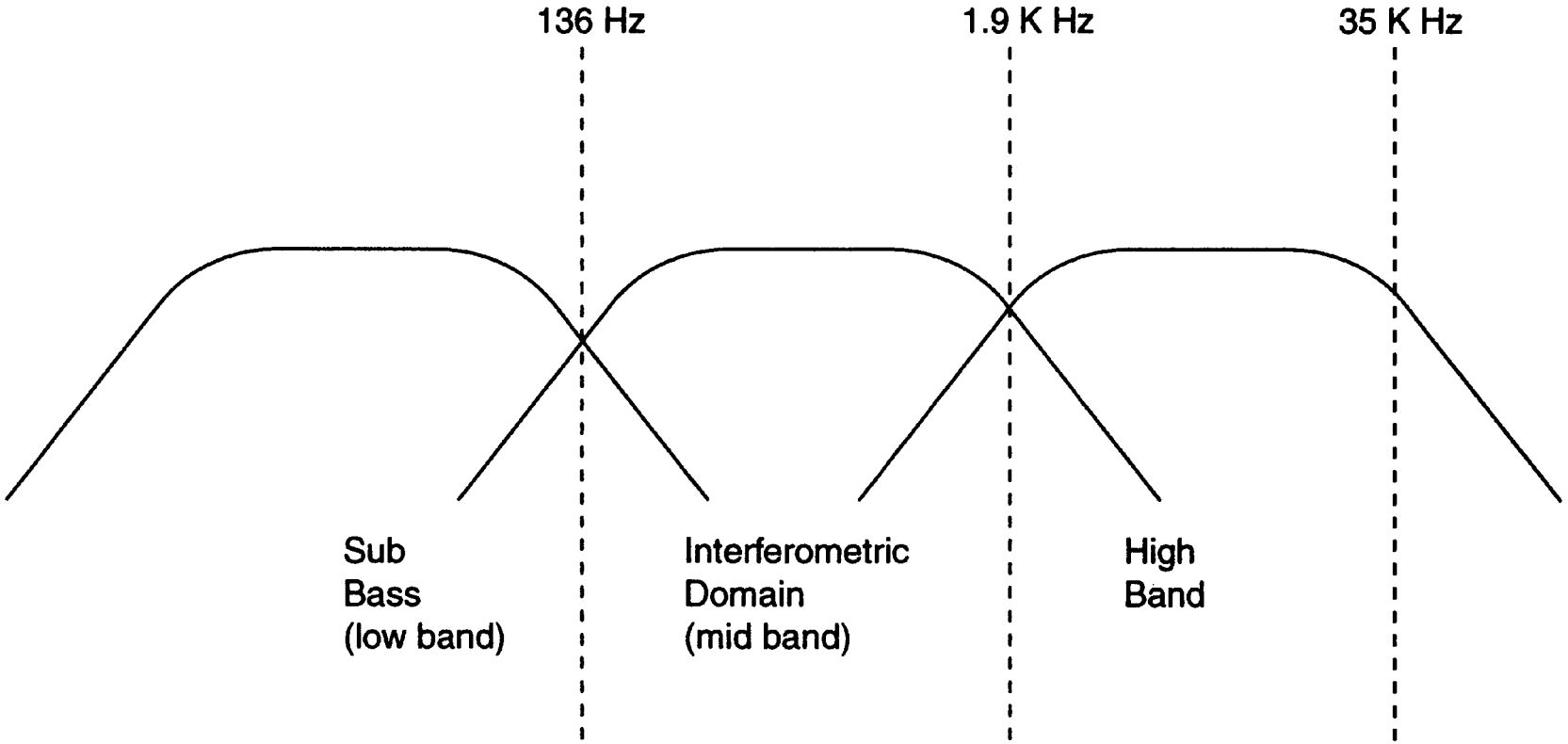
FIG. 4 is an illustrative diagram demonstrating the interferometric domain of the present invention.

The frequency processing bands of the preferred embodiment are depicted in FIG. 4. The sub bass or low band domain is below 136 Hz. The interferometric frequency band or mid band domain is between 136 Hz and 1.9 KHz. The high band domain is between 1.9 KHz and 35 KHz. As previously discussed the most effective values are dependant on the size and distance of the speakers in point source speaker enclosure 6.

Figure 7:
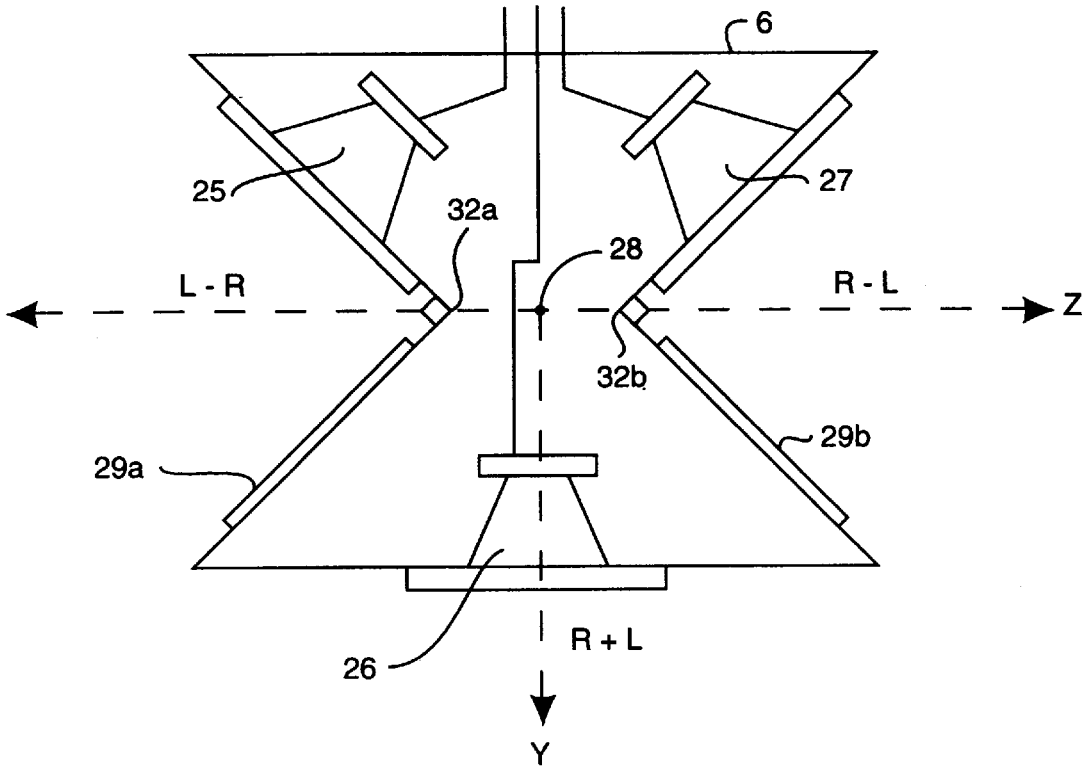
FIG. 7 is a top plan view of the preferred embodiment of the point source speaker enclosure.

Point source speaker enclosure 6 is depicted in detail in FIG. 7 and is configured as a box to house speakers 25, 26 and 27. The walls of point source speaker enclosure 6 are formed of a sturdy material such as wood in order to arrange speakers 25, 26 and 27 as close together as possible. A sturdy material is required since the magnets contained in each of speakers 25, 26 and 27 will create a force pushing speakers 25, 26 and 27 apart. The closer speakers 25, 26 and 27 are together, the higher the high end of the interferometric domain. This is advantageous in that it allows use of the interferometric properties of the present invention over a greater frequency range.

Generally, the smaller the speaker the smaller the distance between speakers 25, 26 and 27 and the wider the interferometric domain. The preferred embodiment employs three 3" speakers and a subwoofer.

Alternate configurations are also possible. For example, speakers 25, 26 and 27 may be 4½" speakers without a subwoofer. A combination point source speaker enclosure housing six speakers is also possible. Such a system would include three smaller speakers such as 3" speakers for the upper end of the interferometric domain and three larger speakers such as 4½" speakers for the lower end of the interferometric domain.

In point source speaker enclosure 6, speakers 25 (left), 26 (center) and 27 (right) are triaxially housed in point source speaker enclosure 6 such that the acoustic waves propagate along the X (left), Y (center) and Z (right) axes, respectively. That is, the acoustic wave propagation axes from left and right speakers 25 and 27 are each arranged along an axis 90° from the axis of center speaker 26. Further, the acoustic wave propagation axes from left and right speakers 25 and 27 are arranged along axes 180° from each other, i.e., in opposing directions. The effect of arranging the acoustic wave propagation axes of speakers 25, 26 and 27 in such a manner is to have the acoustic wave from each of speakers 25, 26 and 27 emanating from a single point of origin 28, hence a point source.

The most expedient shape for point source speaker enclosure 6 is generally a cube having six sides approximately equal size. However, alternate sizes and shapes are possible. In order to provide the best results, speakers 25, 26 and 27 should be placed as close together as possible and the axis of each speaker should intersect at a common point of origin 28.

In the preferred embodiment, the two sides of point source speaker enclosure 6 housing speakers 25 and 27 are comprised of two angled panels 30 and 31 meeting at apex 32 to form an inward V-shape. Speakers 25 and 27 are arranged on panels 30*a* and 30*b*, respectively, while acoustically reflective surfaces 29*a* and 29*b* (formed, for example, by a brass plate) are arranged on the opposing panels 31*a* and 31*b*, respectively. The angle formed at apex 32 is 90° (a right angle). In other words, speaker 25 and acoustically reflective surface 29*a* are arranged in point source speaker enclosure 6 at a right angle from each other. The same is true for speaker 27 and acoustically reflective surface 29*b*. Thus, the acoustic waves from speakers 25 and 27 and the acoustic waves reflected from acoustically reflective surfaces 29 will combine to form an acoustic wave along the X and Z axes, respectively, as depicted in FIG. 7. In this configuration, the maximum amplitude of the combined acoustic wave is along the X and Z axes, which extend through apex 32*a* and 32*b*, and meet at common point of origin 28 with the Y axis.

Figure 8:
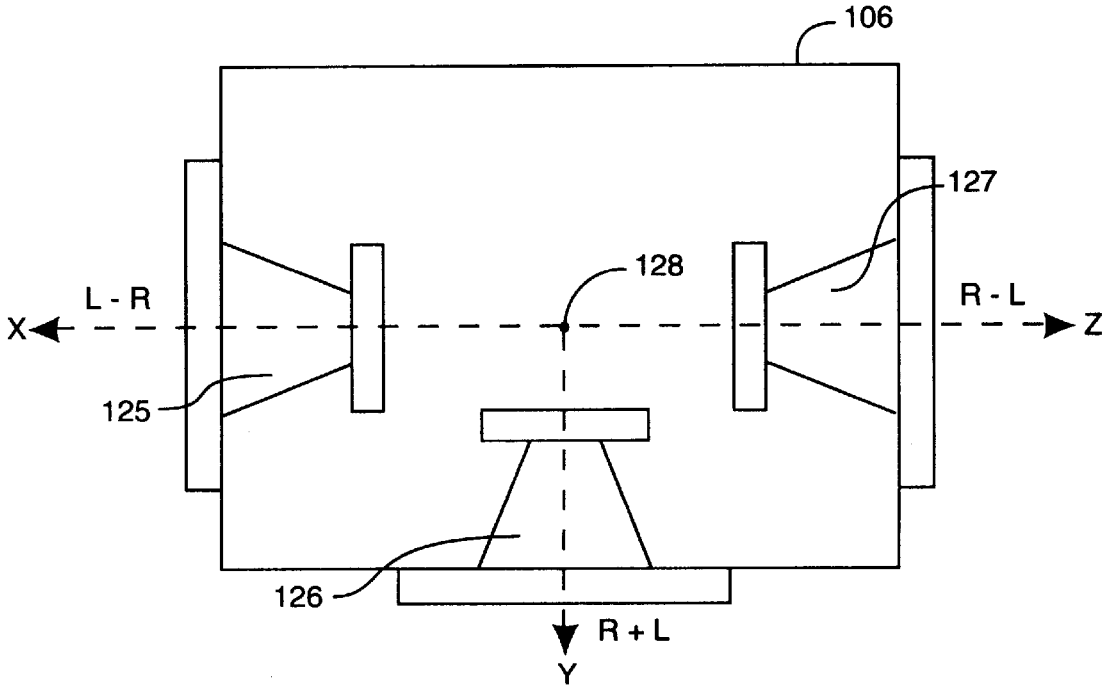
FIG. 8 is a top plan view of an alternate embodiment of the point source speaker enclosure.

This configuration results in a more efficient high frequency acoustic wave propagation than the alternate embodiment shown in FIG. 8. At high frequencies, such as those near or above the interferometric domain high-end cut-off, the acoustic wave becomes highly directional. Due to the directional nature of the wave and the angle of the center line of speakers 25 and 27, rather than being reflected by acoustically reflective surfaces 29, the high frequencies are projected more towards the expected location of the listener. This produces an advantageous high frequency response.

In the preferred embodiment, point source speaker enclosure 6 is approximately 4¼" deep. The shorter depth allows placement of point source speaker enclosure 6 on top of a particular model of a Sharp flat panel television. Larger or smaller enclosures may be used with correspondingly sized speakers depending upon the intended consumer application, however the smaller the speakers, the smaller the enclosure and thus the more the enclosure acts as a point source.

Additionally, point source speaker enclosure is filled with fiber glass to absorb all of the high frequency (HF) backwaves from speakers 25, 26 and 27.

Speakers 25, 26 and 27 are coupled to sonic image differential processor 1 such that left speaker 25 is coupled to op amp 23, center speaker 26 is coupled to op amp 24 and right speaker 27 is coupled to op amp 21. As a result, signal L−R is emitted from left speaker 25, signal R+L is emitted from center speaker 26 and signal R−L is emitted from right speaker 27.

In an alternate and more simplistic embodiment, speakers 125 (left), 126 (center) and 127 (right) are triaxially housed in point source speaker enclosure 106 along the X (left), Y (center) and Z (right) axes, respectively. That is, left and right speakers 125 and 127 are each arranged along an axis 90° from the axis of center speaker 126. Further, left and right speakers 125 and 127 are arranged along axes 180° from each other, i.e., in opposing directions. The effect of arranging speakers 125, 126 and 127 in such a manner is to have the acoustic wave from each of speakers 125, 126 and 127 emanating from a single point of origin 128, hence a point source. This more simplistic configuration also maintains a common point of origin for the acoustic wave propagation along the X, Y and Z axes, as the center line of the three speakers 125, 126 and 127 are aligned directly on the X, Y and Z axes, respectively.

From the above description, it will be apparent that the invention disclosed herein provides a novel and advantageous hybrid data transmission system. The foregoing discussion discloses and describes merely exemplary methods and embodiments of the present invention. One skilled in the art will readily recognize from such discussion that various changes, modifications and variations may be made therein without departing from the spirit and scope of the invention. Accordingly, disclosure of the present invention is intended to be illustrative, but not limiting, of the scope of the invention, which is set forth in the following claims.

I claim:

1. A point source speaker system for producing stereophonic sound based upon left (L) and right (R) audio signals, comprising:

an unitary housing;

a left speaker which produces a L−R acoustic wave comprising said left minus said right (L−R) audio signals;

a center speaker which produces a R+L acoustic wave comprising said right plus said left (R+L) audio signals;

a right speaker which produces a R−L acoustic wave comprising said right minus said right (R−L) audio signals;

a left acoustically reflective surface proximate to said left speaker; and a right acoustically reflective surface proximate to said right speaker;

wherein the left, center, and right speakers and the left and right acoustically reflective surfaces are arranged in said unitary housing such that the axes of the acoustic waves produced by each of the speakers have a common point of origin; and wherein the left speaker is arranged in said unitary housing at a right angle to the left acoustically reflective surface to reflect the L−R acoustic wave and the right speaker is arranged in said unitary housing, at a right angle to the right acoustically reflective surface to reflect the R−L acoustic wave.

2. The point source speaker system of claim 1, wherein the axes of the L−R and R−L acoustic waves are 90° from the axis of the R+L acoustic wave, and said axes of the L−R and R−L acoustic waves are 180° from each other.

3. The point source speaker system of claim 1, wherein the acoustically reflective surfaces are brass plates.

4. The point source speaker system of claim 1, further comprising:

a signal processor, wherein said signal processor processes said left and right audio signals to produce said L−R signal, said R+L signal and said R−L signal.

* * * * *